US010056244B1

(12) United States Patent
Quarmby et al.

(10) Patent No.: US 10,056,244 B1
(45) Date of Patent: Aug. 21, 2018

(54) TUNING MULTIPOLE RF AMPLITUDE FOR IONS NOT PRESENT IN CALIBRANT

(71) Applicant: Thermo Finnigan LLC, San Jose, CA (US)

(72) Inventors: Scott T. Quarmby, Round Rock, TX (US); Joshua T. Maze, Round Rock, TX (US); Nathaniel L. Sanders, Austin, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/662,811

(22) Filed: Jul. 28, 2017

(51) Int. Cl.

| | |
|---|---|
| ***H01J 3/14*** | (2006.01) |
| ***H01J 49/42*** | (2006.01) |
| ***H01J 49/04*** | (2006.01) |
| ***H01J 49/36*** | (2006.01) |
| ***H01J 49/10*** | (2006.01) |
| ***H01J 49/02*** | (2006.01) |

(52) U.S. Cl.
CPC ..... *H01J 49/429* (2013.01); *H01J 49/025* (2013.01); *H01J 49/04* (2013.01); *H01J 49/10* (2013.01); *H01J 49/36* (2013.01); *H01J 49/426* (2013.01); *H01J 49/4225* (2013.01)

(58) Field of Classification Search
None
See application file for complete search history.

(56) References Cited

U.S. PATENT DOCUMENTS

| | | | | |
|---|---|---|---|---|
| 4,535,236 | A * | 8/1985 | Batey | H01J 49/4215 250/282 |
| 2001/0020679 | A1* | 9/2001 | Franzen | H01J 49/004 250/293 |
| 2004/0031918 | A1* | 2/2004 | Schoen | H01J 49/0009 250/282 |
| 2011/0049360 | A1* | 3/2011 | Schoen | H01J 49/0045 250/290 |
| 2012/0223244 | A1* | 9/2012 | Welkie | H01J 37/12 250/396 ML |

* cited by examiner

*Primary Examiner* — Andrew Smyth
(74) *Attorney, Agent, or Firm* — David A. Schell

(57) ABSTRACT

A mass spectrometry apparatus includes an ion source configured to generate ions; an ion guide configured to guide ions from the ion source towards a detector; the ion detector configured to detect ions; and a mass spectrometry controller. The mass spectrometry controller is configured to generate a tune curve for the ion guide; determine an observed low mass cutoff for the ion guide from the tune curve; calculate an effective r0 for the ion guide based on the observed low mass cutoff; determine an RF voltage based on the effective r0 and the RF frequency; apply the RF voltage to the ion guide; and perform a mass analysis of ions in a sample.

23 Claims, 8 Drawing Sheets

TUNING MULTIPOLE RF AMPLITUDE FOR IONS NOT PRESENT IN CALIBRANT

FIELD

The present disclosure generally relates to the field of mass spectrometry including tuning multipole RF amplitude for ions not present in calibrant.

INTRODUCTION

Mass spectrometry can be used to perform detailed analyses on samples.

Furthermore, mass spectrometry can provide both qualitative (is compound X present in the sample) and quantitative (how much of compound X is present in the sample) data for a large number of compounds in a sample. These capabilities have been used for a wide variety of analyses, such as to test for drug use, determine pesticide residues in food, monitor water quality, and the like.

Instrument to instrument variations limits the ability to have a uniform set of parameters that can be used across multiple instruments of the same type. This can be compensated for by running calibration routines for each instrument, but the number of components that need tuning can result in a time consuming calibration routine. Calibration is generally accomplished with the use of a calibration mixture that produces multiple ionic species of known m/z. However, the choice of ions suitable for use in a calibration mixture may be limited. This can be problematic in situations where it is necessary to tune at m/z's outside the range of the calibrant. From the foregoing it will be appreciated that a need exists for improved methods of tuning multipole RF amplitude for ions not present in calibrant.

SUMMARY

In a first aspect, a mass spectrometry apparatus can include an ion source configured to generate ions; an ion guide configured to guide ions from the ion source towards a detector; the ion detector configured to detect ions; and a mass spectrometry controller. The mass spectrometry controller can be configured to generate a tune curve for the ion guide; determine an observed low mass cutoff for the ion guide from the tune curve; calculate an effective r0 for the ion guide based on the observed low mass cutoff; determine an RF voltage based on the effective r0 and the RF frequency; apply the RF voltage to the ion guide; and perform a mass analysis of ions in a sample.

In various embodiments of the first aspect, the ion guide can be a quadrupole, a square quadrupole, a hexapole, an octopole, a stacked ring ion guide, an ion funnel, an ion carpet, or any combination thereof.

In various embodiments of the first aspect, the mass spectrometry controller can be configured to calculate the effective r0 based on the observed low mass cutoff, a nominal r0, and an expected low mass cutoff.

In particular embodiments, the mass spectrometry controller can be configured to calculate the effective r0 according to $$r0_{effective} = \sqrt{K_{observed} * r0^2_{nominal} / K_{expected}}$$

where $K_{expected}$ is the expected value for a parameter and $K_{observed}$ is the observed value for the parameter, the parameter selected from q, q*(m/z), q*(m/z)*$\omega^2$, q*(m/z)*$f^2$, V, V/$\omega^2$, V/$f^2$, or a combination thereof.

In particular embodiments, the mass spectrometry controller can be configured to calculate the effective r0 according to $$r0_{effective} = \sqrt{\text{cutoff}_{observed} * r0^2_{nominal} / \text{cutoff}_{expected}}\ .$$

In various embodiments of the first aspect, the observed low mass cutoff can be an average across at least two calibrant ion species.

In various embodiments of the first aspect, the RF voltage can be determined based on the effective r0, the frequency of the RF voltage, and a tune table.

In particular embodiments, the tune table can include optimum q values for mass-to-charge ratios.

In a second aspect, a method of analyzing ion fragments can include generating a tune curve for an ion guide; determining an observed low mass cutoff for the ion guide from the tune curve; calculating an effective r0 for the ion guide based on the observed low mass cutoff; determining an RF voltage based on the effective r0 and the RF frequency; applying the RF voltage to the ion guide; and performing a mass analysis of ions in a sample.

In various embodiments of the second aspect, the ion guide can be a quadrupole, a square quadrupole, a hexapole, an octopole, a stacked ring ion guide, an ion funnel, an ion carpet, or any combination thereof.

In various embodiments of the second aspect, calculating an effective r0 can be based on the observed low mass cutoff, a nominal r0, and an expected low mass cutoff.

In particular embodiments, t calculating the effective r0 can be in accordance with $$r0_{effective} = \sqrt{K_{observed} * r0^2_{nominal} / K_{expected}}$$

where $K_{expected}$ is the expected value for a parameter and $K_{observed}$ is the observed value for the parameter, the parameter selected from q, q*(m/z), q*(m/z)*$\omega^2$, q*(m/z)*$f^2$, V, V/$\omega^2$, V/$f^2$, or a combination thereof.

In particular embodiments, calculating the effective r0 can be in accordance with $$r0_{effective} = \sqrt{\text{cutoff}_{observed} * r0^2_{nominal} / \text{cutoff}_{expected}}\ .$$

In various embodiments of the second aspect, the observed low mass cutoff can be an average across at least two calibrant ion species.

In various embodiments of the second aspect, the RF voltage can be determined based on the effective r0, the RF frequency, and a tune table. In particular embodiments, the tune table includes optimum q values for mass-to-charge ratios.

In a third aspect, a non-transitory computer readable medium can include instructions that when implemented by a processor perform the steps of generating a tune curve for an ion guide; determining a low mass cutoff for the ion guide from the tune curve; calculating an effective r0 for the ion guide based on the observed low mass cutoff; determining an RF voltage based on the effective r0 and the RF frequency;

applying the RF voltage to the ion guide; and performing a mass analysis of ions in a sample.

In various embodiments of the third aspect, the ion guide can be a quadrupole, a square quadrupole, a hexapole, an octopole, a stacked ring ion guide, an ion funnel, an ion carpet, or any combination thereof.

In various embodiments of the third aspect, the instructions to calculate the effective r0 can be based on the observed low mass cutoff, a nominal r0, and an expected low mass cutoff.

In particular embodiments, the instructions to calculate the effective r0 can be in accordance with $$r0_{effective} = \sqrt{K_{observed} * r0^2_{nominal} / K_{expected}}$$

where $K_{expected}$ is the expected value for a parameter and $K_{observed}$ is the observed value for the parameter, the parameter selected from q, q*(m/z), q*(m/z)*$\omega^2$, q*(m/z)*$f^2$, V, V/$\omega^2$, V/$f^2$, or a combination thereof.

In particular embodiments, the instructions to calculate the effective r0 can be in accordance with $$r0_{effective} = \sqrt{\text{cutoff}_{observed} * r0^2_{nominal} / \text{cutoff}_{expected}}\ .$$

In various embodiments of the third aspect, the observed low mass cutoff can be an average across at least two calibrant ion species.

In various embodiments of the third aspect, the RF voltage can be determined based on the effective r0, the RF frequency, and a tune table.

DRAWINGS

For a more complete understanding of the principles disclosed herein, and the advantages thereof, reference is now made to the following descriptions taken in conjunction with the accompanying drawings and exhibits, in which.

Figure 1:
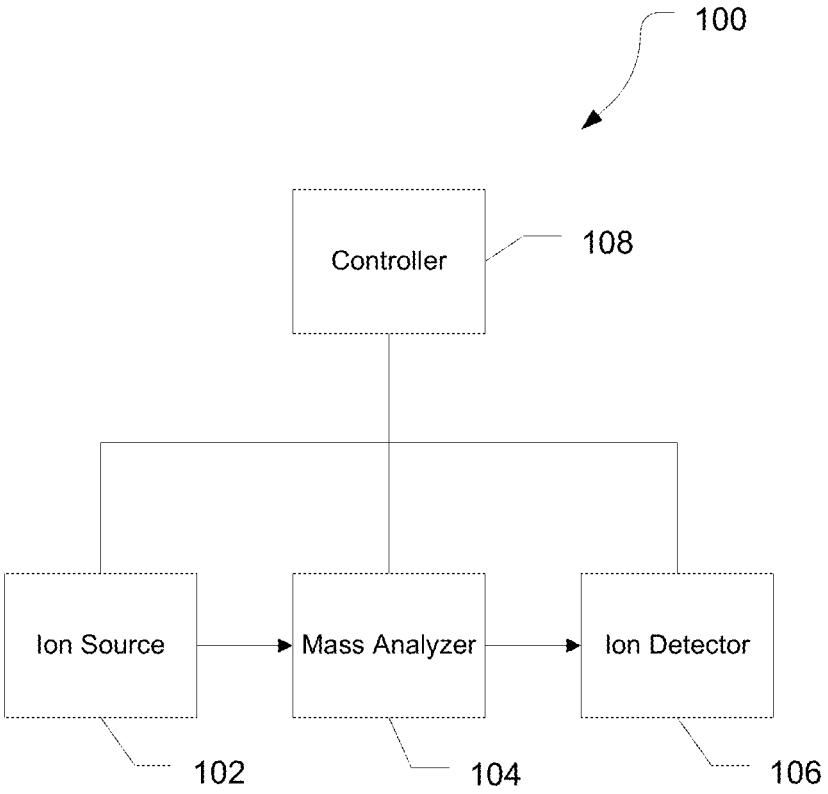
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

The term "optimal" refers to any value that is determined to be numerically better than one or more other values. For example, an optimal value is not necessarily the best possible value, but may simply satisfy a criterion (e.g. a change in a cost function from a previous value is within tolerance). Thus, the optimal solution can be one that is not the very best possible solution, but simply one that is better than another solution according to a criterion.

Mass Spectrometry Platforms

Various embodiments of mass spectrometry platform 100 can include components as displayed in the block diagram of FIG. 1. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, including when mass analyzer 104 is an ion trap, the mass analyzer 104 can also be configured or include an additional device to fragment ions using resonance excitation or collision cell collision induced dissociation (CID), electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detect negative ions.

Determining Effective R0

Figure 2:
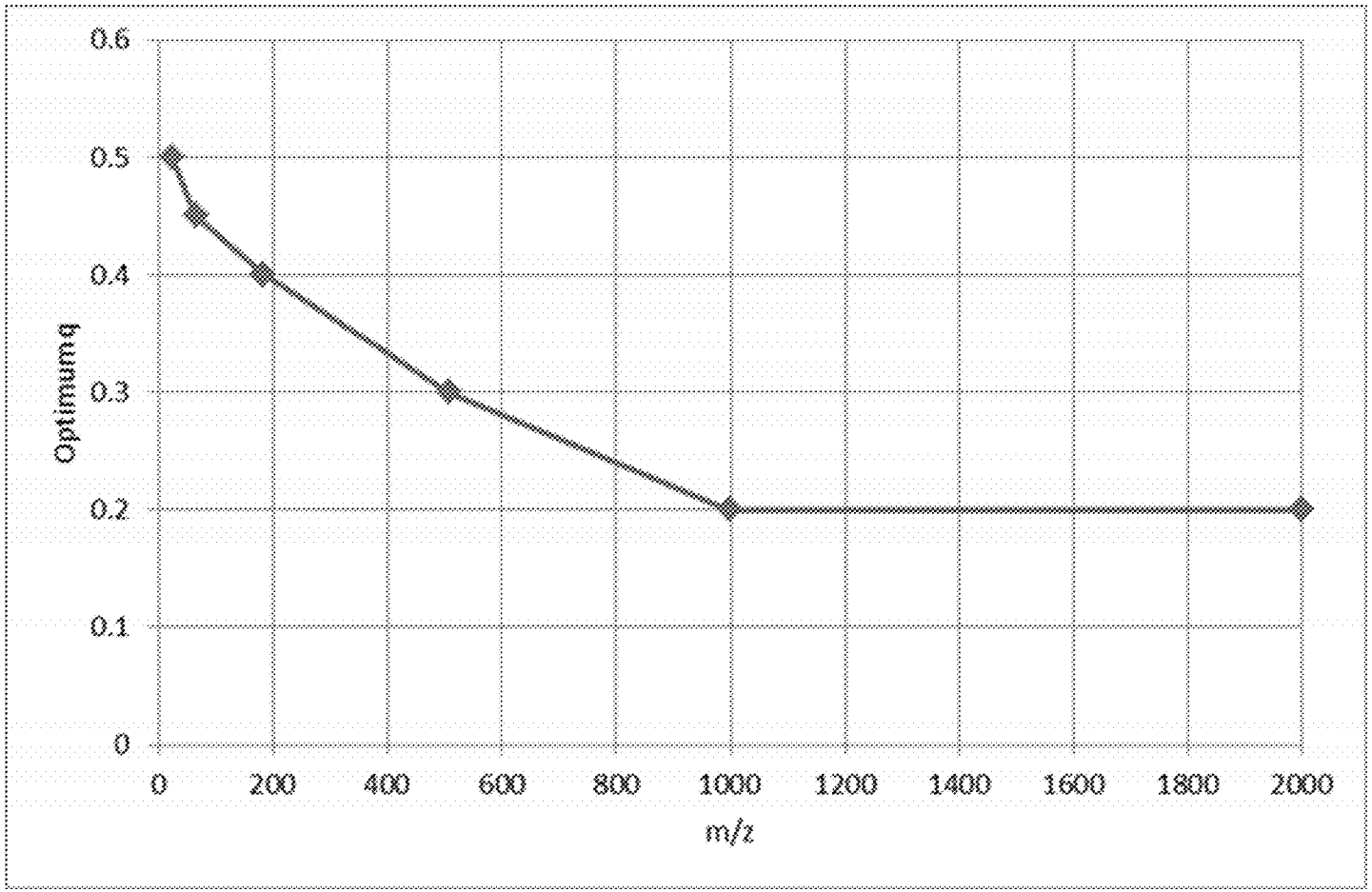
FIG. 2 is a diagram illustrating the optimum q as a function of m/z, in accordance with various embodiments.

It is known that the optimum q of a multipole ion guide is a function of m/z. Typically, an optimum q is determined for a series of different m/z ions to construct a tune table for an ion guide. The tune table can then be used to determine the RF voltage necessary for the ion guide to pass a particular mass range of ions. FIG. 2 shows an exemplary graph of optimal q as a function of mass for an exemplary ion guide. In various embodiments, the ion guide can be a quadrupole, a square quadrupole, a hexapole, an octopole, a stacked ring ion guide, an ion funnel, an ion carpet, any combination thereof, or any other multipole ion guide known in the art.

The tune table can be determined on a particular instrument, but the mass range is limited based on the available calibrant mixture. Additionally, tuning the ion optics can be time consuming. Alternatively, a tune table can be generated for an instrument line and factory installed. The tune table can include the optimal q (or q*m) for a series of masses. The factory installed tune table can be generated using a broader range of calibrant masses and eliminate the need to perform the calibration on each instrument.

However, it has been observed that variations between ion guide assemblies can cause the optimum q to differ between instruments. The cause of the variations can be traced to variations in the mechanical dimensions, specifically $r_0$, between instruments and ion guide assemblies. A method for determining the effective $r_0$ of an ion guide is disclosed. Using the effective $r_0$ rather than a nominal $r_0$, can control for the instrument-to-instrument variations due to differences in mechanical dimensions.

Figure 3:
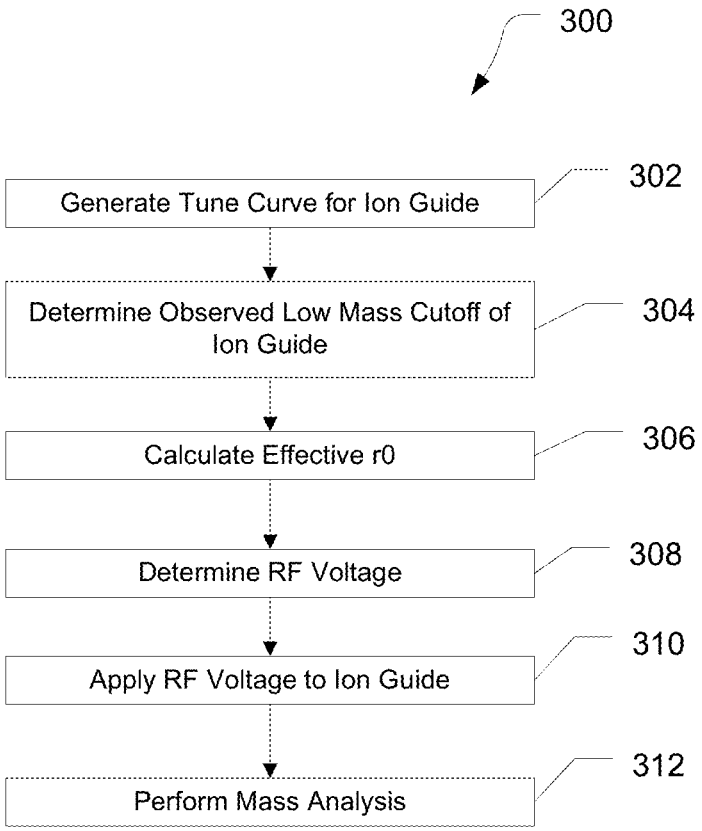
FIG. 3 is a flow diagram illustrating an exemplary method of an RF amplitude of a multipole ion guide, in accordance with various embodiments.

FIG. 3 illustrates an exemplary method 300 of calibrating an ion guide for use during a mass analysis. At 302, a tune curve for the ion guide can be generated. In various embodiments, the tune curve can be generated by varying the RF amplitude of the ion guide and measuring the peak area of a calibrant ion as the q of the ion changes with RF amplitude. Data can be generated for a plurality of calibrant ions of different masses.

At 304, an observed low mass cutoff can be determined for the ion guide. The observed low mass cutoff can be the q value at which the ions stop transmitting, such as when the intensity of the calibrant ion drops to near 0, at the high end of the tune curve.

At 306, an effective $r_0$ can be calculated. $r_0$ is the distance from the center axis (the z axis) to the surface of any electrode (rod). Due to variations in the manufacturing of the ion guide, the effective $r_0$ can vary from the nominal $r_0$ to a small degree. This can be due to small variations in the diameter and placement of the rods, or other variations in manufacturing. By calculating the effective $r_0$ for the instrument, corrections for these instrument variations can be compensated for and instrument-to-instrument variability can be reduced.

The effective r0 can be calculated using a ratio of q, $q*(m/z)$, $q*(m/z)*\omega^2$, $q*(m/z)*f^2$, V, $V/\omega^2$, $V/f^2$, or any combination thereof, from Equation 1.

$$q = \frac{4eV}{(m/z)\omega^2 r_0^2} \qquad \text{Equation 1}$$

In various embodiments, K can be defined as one of the values from above, the effective r0 can be calculated using Equation 2.

$$r0_{effective} = \sqrt{K_{observed} * r0^2_{nominal} / K_{expected}} \qquad \text{Equation 2}$$

where $r0_{nominal}$ is the assumed $r_0$ of the ion guide used in generating the tune curve, $K_{observed}$ is the value observed at a point in the tune curve such as a low mass cutoff, $K_{expected}$ is the value of that point when the tune table was created, and $r0_{effective}$ is the calculated $r_0$ of the ion guide. In various embodiments $r0_{nominal}$ can be the theoretical r0 of the multipole.

In particular embodiments, the effective r0 can be calculated using Equation 3.

$$r0_{effective} = \sqrt{\text{cutoff}_{observed} * r0^2_{nominal} / \text{cutoff}_{expected}}\ . \qquad \text{Equation 3}$$

where $r0_{nominal}$ is the assumed $r_0$ of the ion guide used in generating the tune curve, cutoff observed is the q at the observed low mass cutoff, and $r0_{effective}$ is the calculated $r_0$ of the ion guide. $\text{Cutoff}_{expected}$ can be the q value at the expected low mass cutoff. In various embodiments, $\text{cutoff}_{expected}$ can be based on theoretical calculations. For example, the $cutoff_{expected}$ for a quadrupole can be a q of 0.908. In other embodiments, the $cutoff_{expected}$ can be the q value at the low mass cutoff when the tune table was created.

In various embodiments, the effective $r_0$ can be determined based on one of the calibrant ion in the calibrant mix. The selected calibrant ion can have a mass near the middle of the mass range covered by the calibrant mix, or at the high or low end of the mass range, or anywhere in between. In other embodiments, the effective r0 can be an average of the effective $r_0$ calculated for two or more calibrant ions within the calibrant mix. In yet another example, the effective r0 can be calculated using an average observed low mass cutoff from two or more calibrant ions within the calibrant mix.

At 308, an RF voltage for the ion guide can be determined based on the effective $r_0$. In various embodiments, RF voltage can depend on the mass range of interest. Additionally, the RF voltage of the ion guide can depend on the RF frequency. In various embodiments, a tune table can be used to determine the RF voltage of the ion guide. The tune table can have optimal q*m values (product of the q and the mass) determined for a number of masses. Using these optimal q*m values and the $r_0$, the RF voltage can be determined for a target mass or target mass range (see Equation 1). At 310, the RF voltage can be applied to the ion guide, and at 312 a mass analysis can be performed.

Computer-Implemented System

Figure 4:
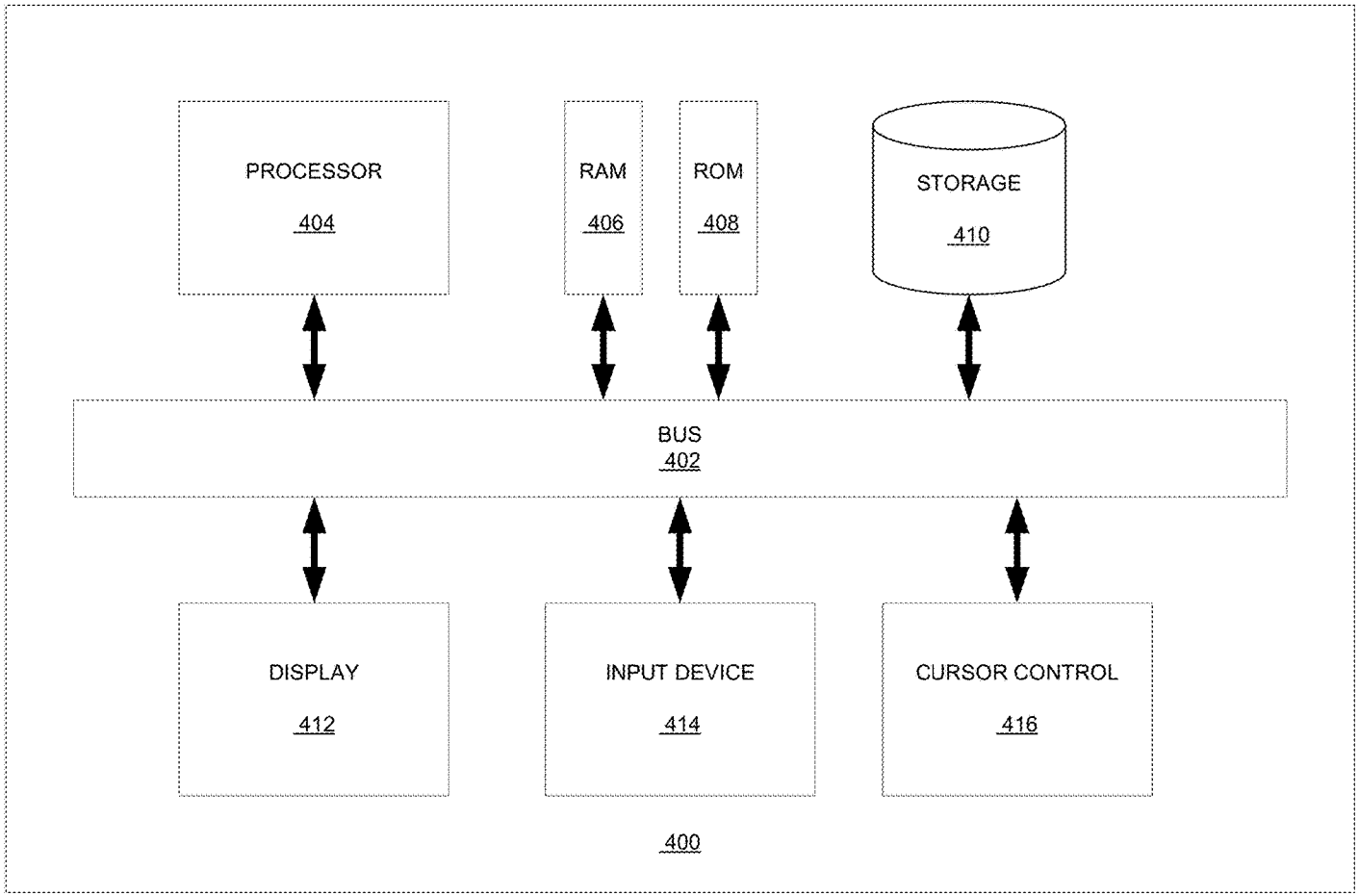
FIG. 4 is a block diagram illustrating an exemplary computer system.

FIG. 4 is a block diagram that illustrates a computer system 400, upon which embodiments of the present teachings may be implemented as which may incorporate or communicate with a system controller, for example controller 48 shown in FIG. 1, such that the operation of components of the associated mass spectrometer may be adjusted in accordance with calculations or determinations made by computer system 400. In various embodiments, computer system 400 can include a bus 402 or other communication mechanism for communicating information, and a processor 404 coupled with bus 402 for processing information. In various embodiments, computer system 400 can also include a memory 406, which can be a random access memory (RAM) or other dynamic storage device, coupled to bus 402, and instructions to be executed by processor 404. Memory 406 also can be used for storing temporary variables or other intermediate information during execution of instructions to be executed by processor 404. In various embodiments, computer system 400 can further include a read only memory (ROM) 408 or other static storage device coupled to bus 402 for storing static information and instructions for processor 404. A storage device 410, such as a magnetic disk or optical disk, can be provided and coupled to bus 402 for storing information and instructions.

In various embodiments, computer system 400 can be coupled via bus 402 to a display 412, such as a cathode ray tube (CRT) or liquid crystal display (LCD), for displaying information to a computer user. An input device 414, including alphanumeric and other keys, can be coupled to bus 402 for communicating information and command selections to processor 404. Another type of user input device is a cursor control 416, such as a mouse, a trackball or cursor direction keys for communicating direction information and command selections to processor 404 and for controlling cursor movement on display 412. This input device typically has two degrees of freedom in two axes, a first axis (i.e., x) and a second axis (i.e., y), that allows the device to specify positions in a plane.

A computer system 400 can perform the present teachings. Consistent with certain implementations of the present teachings, results can be provided by computer system 400 in response to processor 404 executing one or more sequences of one or more instructions contained in memory 406. Such instructions can be read into memory 406 from another computer-readable medium, such as storage device 410. Execution of the sequences of instructions contained in memory 406 can cause processor 404 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 404 for execution. Such a medium can take many forms, including but not limited to, non-volatile media, volatile media, and transmission media. Examples of non-volatile media can include, but are not limited to, optical or magnetic disks, such as storage device 410. Examples of volatile media can include, but are not limited to, dynamic memory, such as memory 406. Examples of transmission media can include, but are not limited to, coaxial cables, copper wire, and fiber optics, including the wires that comprise bus 402.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages and on conventional computer or embedded digital systems.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Results

Figure 5:
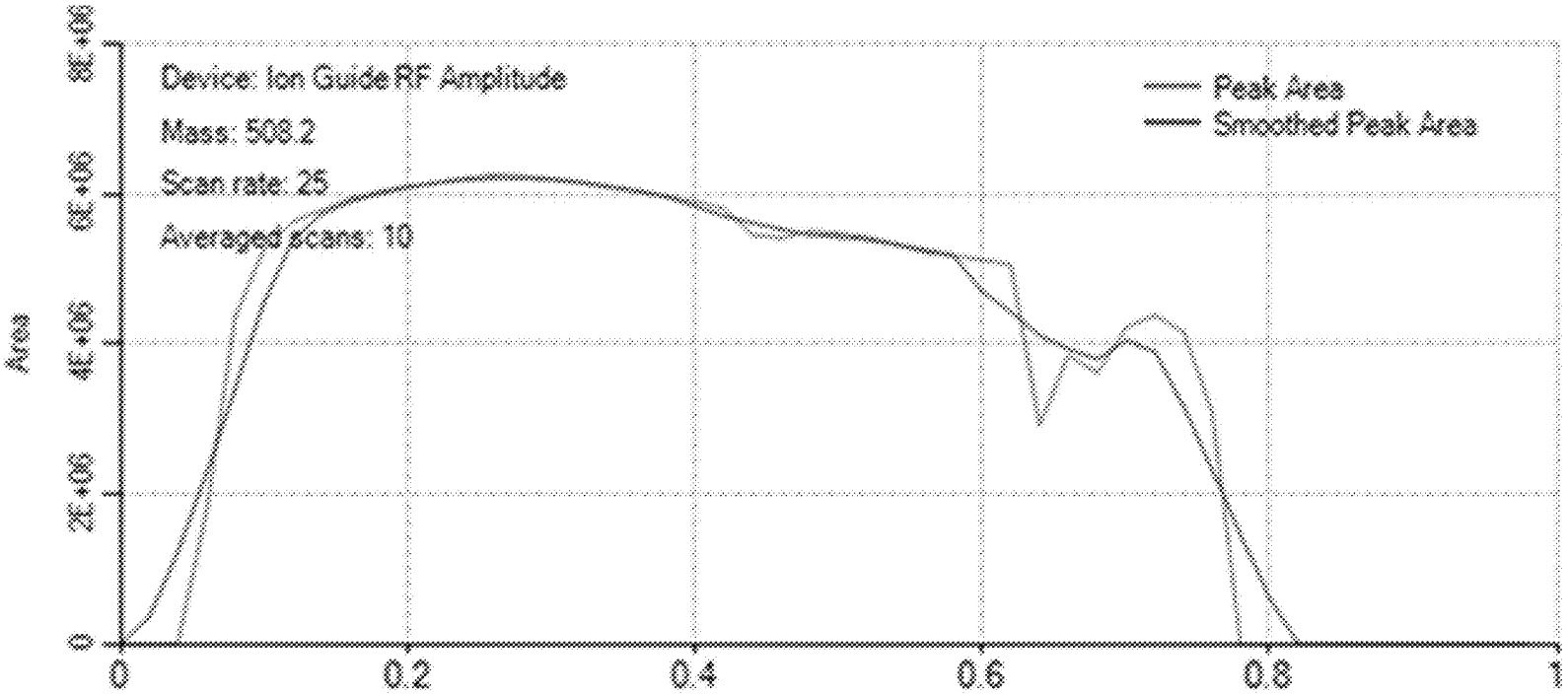
FIG. 5 is a graph illustrating a tune curve using a nominal r0, in accordance with various embodiments.

FIG. 5 shows an exemplary tune curve of a calibration ion at m/z 508.2 for an exemplary ion guide using a nominal $r_0$ of 2.49 mm. The tune curve is determined by scanning RF voltage to adjust the q value and the peak area of the calibration ion is measured. As can be seen, the low mass cutoff is about q=0.8, below the expected value of q=0.908. That is, the assumed q value based on the nominal $r_0$ is low. Using Equation 1 results in an effective r0 of 2.33 mm.

Figure 6:
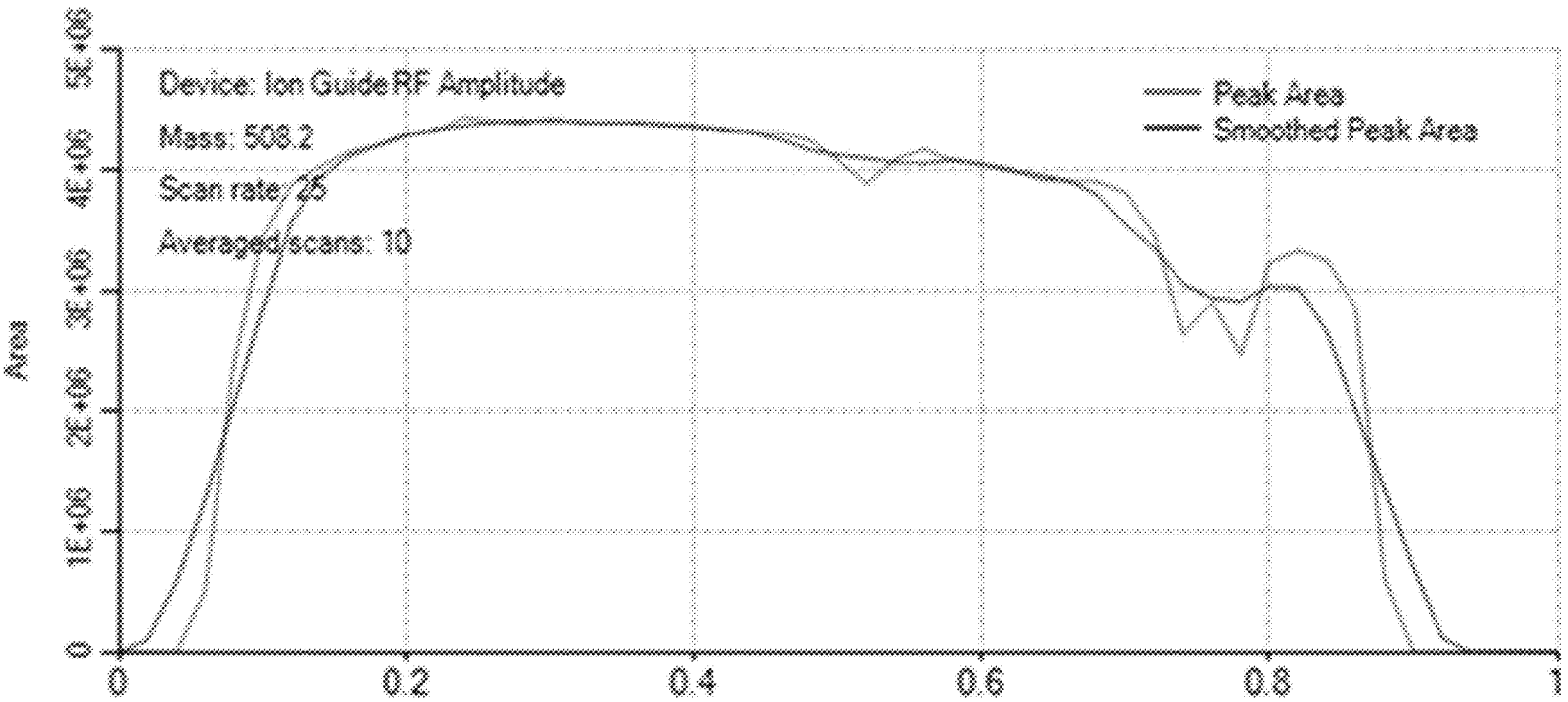
FIG. 6 is a graph illustrating a tune curve using an effective r0, in accordance with various embodiments.

FIG. 6 shows an exemplary tune curve of a calibration ion at m/z 508.2 using the effective r0 of 2.33 mm. After calculating the effective $r_0$ and adjusting the underlying calculations to set the RF voltage using the effective $r_0$, ions stop transmitting at q=0.908 as expected.

Figure 7:
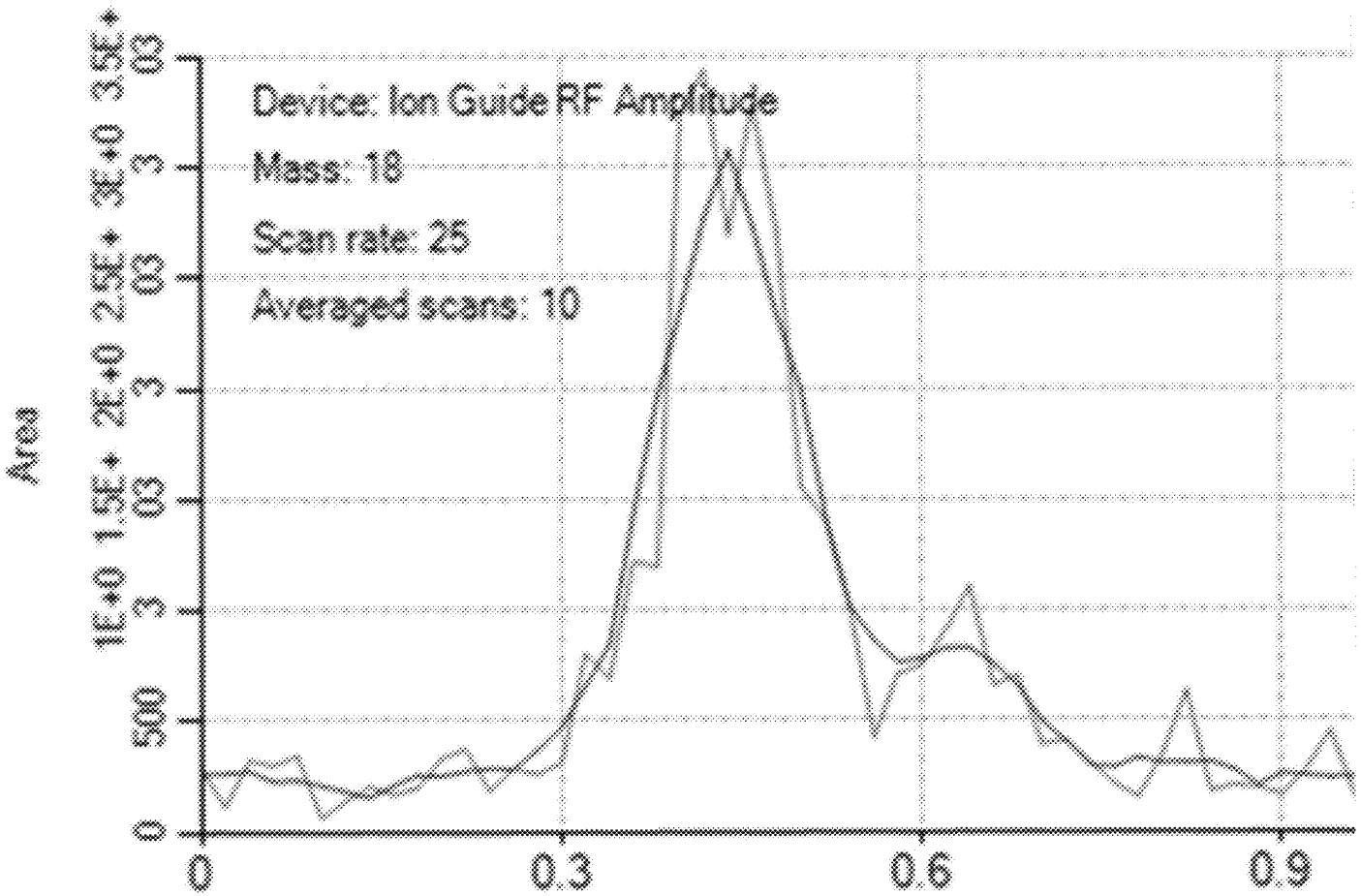
FIG. 7 is a Q0 RF q lens tune curve before determining the effective r0, in accordance with various embodiments.
Figure 8:
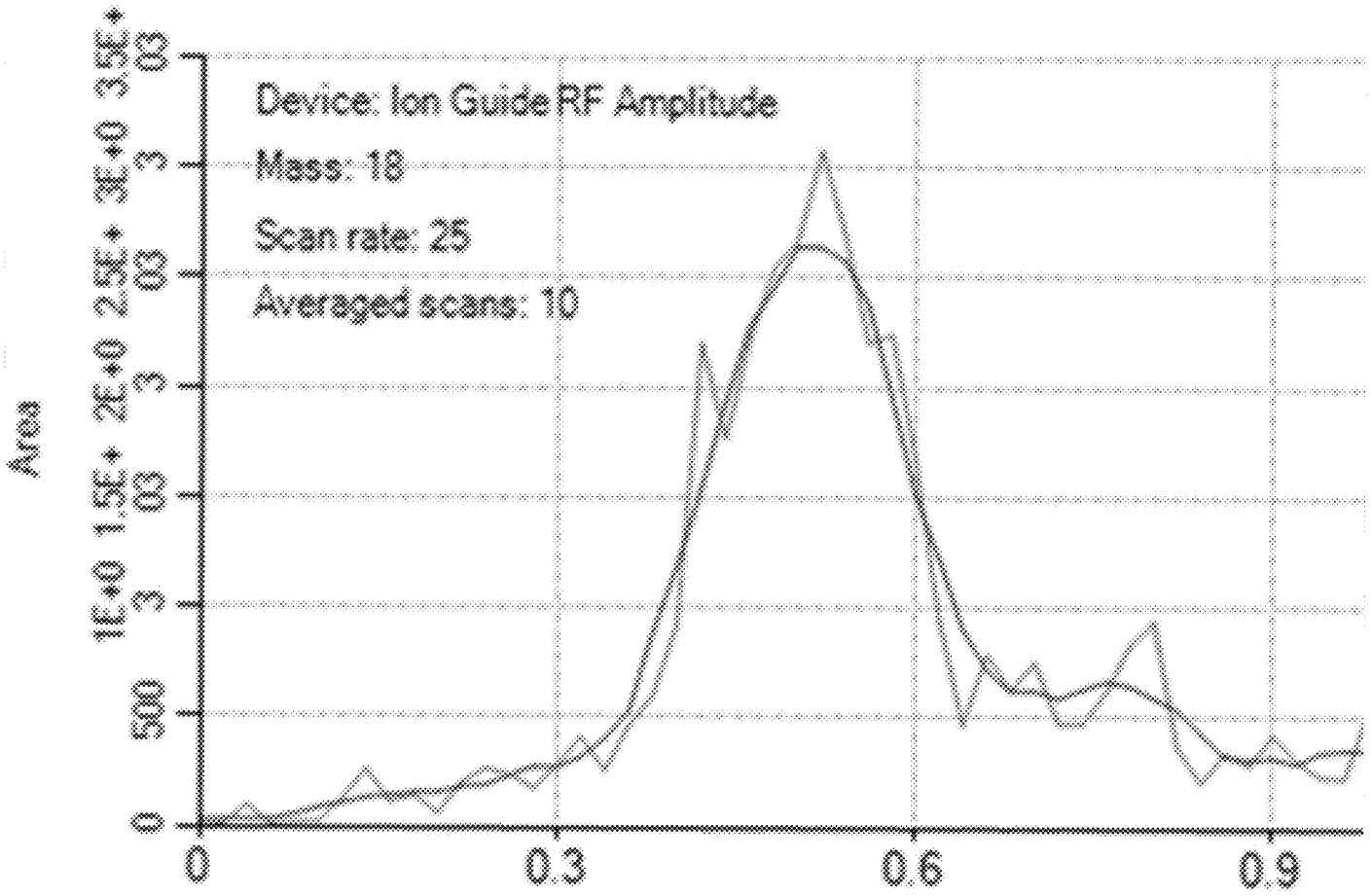
FIG. 8 is a Q0 RF q lens tune curve after determining the effective r0, in accordance with various embodiments.

The importance of using the correct $r_0$ can be seen by comparing FIGS. 7 and 8. FIGS. 7 and 8 show tune curves for a low mass ion at mass 18. FIG. 7 shows the tune curve based on the nominal $r_0$ while FIG. 8 shows the tune curve after correcting to the effective $r_0$. Low m/z ions have sharp tuning curves. There is a significant shift in the location of the maximum between FIG. 7 and FIG. 8. Using a fixed tuning curve with a q of 0.5 would result in half the intensity of the m/z 18 ion until the $r_0$ is corrected. A larger difference between the effective $r_0$ and the nominal $r_0$ could result in complete loss of the low mass ions.

What is claimed is:

1. A mass spectrometry apparatus comprising:
an ion source configured to generate ions;
an ion guide configured to guide ions from the ion source towards a detector;
the ion detector configured to detect ions; and
a mass spectrometry controller configured to:
generate a tune curve for the ion guide;
determine an observed low mass cutoff for the ion guide from the tune curve;
calculate an effective r0 for the ion guide based on the observed low mass cutoff;
determine an RF voltage based on the effective r0 and the RF frequency;
apply the RF voltage to the ion guide; and
perform a mass analysis of ions in a sample.

2. The mass spectrometry system of claim 1 wherein the ion guide is a quadrupole, a square quadrupole, a hexapole, an octopole, a stacked ring ion guide, an ion funnel, an ion carpet, or any combination thereof.

3. The mass spectrometry system of claim 1 wherein the processor is configured to calculate the effective r0 based on the observed low mass cutoff, a nominal r0, and an expected low mass cutoff.

4. The mass spectrometry system of claim 3 wherein the processor is configured to calculate the effective r0 according to $$r0_{effective} = \sqrt{K_{observed} * r0^2_{nominal} / K_{expected}}$$

where $K_{expected}$ is the expected value for a parameter and $K_{observed}$ is the observed value for the parameter, the parameter selected from q, q*(m/z), q*(m/z)*$\omega^2$, q*(m/z)*$f^2$, V, V/$\omega^2$, V/$f^2$, or a combination thereof.

5. The mass spectrometry system of claim 3 wherein the processor is configured to calculate the effective r0 according to $$r0_{effective} = \sqrt{\text{cutoff}_{observed} * r0^2_{nominal} / \text{cutoff}_{expected}}\ .$$

6. The mass spectrometry system of claim 1 wherein the observed low mass cutoff is an average across at least two calibrant ion species.

7. The mass spectrometry system of claim 1 wherein the RF voltage is determined based on the effective r0, the frequency of the RF voltage, and a tune table.

8. The mass spectrometry system of claim 7 wherein the tune table includes optimum q values for mass-to-charge ratios.

9. A method of analyzing ion fragments, comprising:
generating a tune curve for an ion guide;
determining an observed low mass cutoff for the ion guide from the tune curve;
calculating an effective r0 for the ion guide based on the observed low mass cutoff;

determining an RF voltage based on the effective r0 and the RF frequency;

applying the RF voltage to the ion guide; and performing a mass analysis of ions in a sample.

10. The method of claim 9 wherein the ion guide is a quadrupole, a square quadrupole, a hexapole, an octopole, a stacked ring ion guide, an ion funnel, an ion carpet, or any combination thereof.

11. The method of claim 9 wherein calculating an effective r0 is based on the observed low mass cutoff, a nominal r0, and an expected low mass cutoff.

12. The method of claim 11 wherein calculating the effective r0 is in accordance with $$r0_{effective} = \sqrt{K_{observed} * r0^2_{nominal} / K_{expected}}$$

the expected value for a parameter and $K_{observed}$ is the observed value for the parameter, the parameter selected from q, q*(m/z), q*(m/z)*$\omega^2$, q*(m/z)*$f^2$, V, V/$\omega^2$, V/$f^2$, or a combination thereof.

13. The method of claim 11 wherein calculating the effective r0 is in accordance with $$r0_{effective} = \sqrt{\text{cutoff}_{observed} * r0^2_{nominal} / \text{cutoff}_{expected}}\ .$$

14. The method of claim 9 wherein the observed low mass cutoff is an average across at least two calibrant ion species.

15. The method of claim 9 wherein the RF voltage is determined based on the effective r0, the RF frequency, and a tune table.

16. The method of claim 15 wherein the tune table includes optimum q values for mass-to-charge ratios.

17. A non-transitory computer readable medium containing instructions that when implemented by a processor perform the steps of:

generating a tune curve for an ion guide;

determining a low mass cutoff for the ion guide from the tune curve;

calculating an effective r0 for the ion guide based on the observed low mass cutoff;

determining an RF voltage based on the effective r0 and the RF frequency;

applying the RF voltage to the ion guide; and performing a mass analysis of ions in a sample.

18. The non-transitory computer readable medium of claim 17 wherein the ion guide is a quadrupole, a square quadrupole, a hexapole, an octopole, a stacked ring ion guide, an ion funnel, an ion carpet, or any combination thereof.

19. The non-transitory computer readable medium of claim 17 wherein the instructions to calculate the effective r0 are based on the observed low mass cutoff, a nominal r0, and an expected low mass cutoff.

20. The non-transitory computer readable medium of claim 19 wherein the instructions to calculate the effective r0 are in accordance with $$r0_{effective} = \sqrt{K_{observed} * r0^2_{nominal} / K_{expected}}$$

where $K_{expected}$ is the expected value for a parameter and $K_{observed}$ is the observed value for the parameter, the parameter selected from q, q*(m/z), q*(m/z)*$\omega^2$, q*(m/z)*$f^2$, V, V/$\omega^2$, V/$f^2$, or a combination thereof.

21. The non-transitory computer readable medium of claim 19 wherein the instructions to calculate the effective r0 are in accordance with $$r0_{effective} = \sqrt{\text{cutoff}_{observed} * r0^2_{nominal} / \text{cutoff}_{expected}}\ .$$

22. The non-transitory computer readable medium of claim 17 wherein the observed low mass cutoff is an average across at least two calibrant ion species.

23. The non-transitory computer readable medium of claim 17 wherein the RF voltage is determined based on the effective r0, the RF frequency, and a tune table.

* * * * *